US006705917B2

(12) United States Patent
Filo

(10) Patent No.: US 6,705,917 B2
(45) Date of Patent: Mar. 16, 2004

(54) SELF-PHASE SYNCHRONIZED WALKING AND TURNING QUADRUPED APPARATUS

(75) Inventor: Andrew S. Filo, 22670 Oakcrest Ct., Cupertino, CA (US) 95014

(73) Assignee: Andrew S. Filo, Cupertino, CA (US)

( * ) Notice: Subject to any disclaimer, the term of this patent is extended or adjusted under 35 U.S.C. 154(b) by 67 days.

(21) Appl. No.: 10/006,118

(22) Filed: Dec. 6, 2001

(65) Prior Publication Data

US 2002/0111113 A1 Aug. 15, 2002

Related U.S. Application Data

(60) Provisional application No. 60/255,974, filed on Dec. 15, 2000.

(51) Int. Cl.[7] ..... A63H 3/46

(52) U.S. Cl. ..... 446/379; 446/356; 446/377; 180/8.1; 180/8.6

(58) Field of Search ..... 446/355, 352, 446/353, 356, 358, 376–381, 390; 901/1; 180/8.1, 8.6

(56) References Cited

U.S. PATENT DOCUMENTS

| | | | | |
|---|---|---|---|---|
| 2,924,042 A | * | 2/1960 | Byrtus | 446/356 |
| 3,331,463 A | * | 7/1967 | Kramer | 180/8.6 |
| 4,613,315 A | | 9/1986 | Kataoka | |
| 4,629,440 A | * | 12/1986 | McKittrick et al. | 446/356 |
| 4,834,200 A | | 5/1989 | Kajita | |
| 4,840,242 A | * | 6/1989 | Chih et al. | 180/8.1 |
| 5,040,626 A | | 8/1991 | Paynter | |
| 5,049,802 A | | 9/1991 | Mintus et al. | |
| 5,151,859 A | | 9/1992 | Yoshino et al. | |
| 5,158,493 A | | 10/1992 | Morgrey | |
| 5,159,988 A | | 11/1992 | Gomi et al. | |

(List continued on next page.)

FOREIGN PATENT DOCUMENTS

| | | |
|---|---|---|
| EP | 0 818 283 A1 | 1/1998 |
| EP | 0 898 237 A2 | 2/1999 |
| EP | 0 923 011 A2 | 6/1999 |
| EP | 0 924 034 A2 | 6/1999 |
| JP | 1050592 | 6/1999 |
| JP | 1038550 | 9/1999 |
| JP | 1050592-1 | 9/1999 |
| WO | WO 99/64208 | 12/1999 |
| WO | WO 99/67067 | 12/1999 |

*Primary Examiner*—Jacob K. Ackun
*Assistant Examiner*—Bena B. Miller
(74) *Attorney, Agent, or Firm*—Michael Best & Friedrich LLP

(57) ABSTRACT

An apparatus that is capable of achieving self-synchronized walking and turning includes a first motor that is attached to the apparatus that is in communication with a first limb and a second motor, independent from the first motor, that is attached to the apparatus and is in communication with a second limb. Initially, the lateral phase differential is set at 180 degrees and is maintained by a dampening mechanism that is interposed between the two limbs, or other movable members mechanically linked thereto, making sure that apparatus walks in a straight line. Regulators may forcibly upset this balance by speeding up one of the motors, thereby overcoming the force exerted by the damper mechanism, causing one limb to move faster than the other limb. This results in the apparatus turning in a prescribed radius. Finally, the regulators may withdraw their disturbing force, thereby allowing the force supplied by the dampening mechanism to slow down the faster moving limb until a lateral phase differential of 180 degrees is restored. This results in the apparatus walking in a straight line once more. This method of walking and turning works whether the apparatus is walking in a forward or reverse direction. Alternatively, a counter-phase differential of 90 degrees can be used to cause the apparatus to turn on its axis.

18 Claims, 17 Drawing Sheets

U.S. PATENT DOCUMENTS 5,209,695 A 5/1993 Rothschild
5,220,263 A 6/1993 Onishi et al.
5,221,883 A 6/1993 Takenaka et al.
5,250,886 A 10/1993 Yasuhara et al.
5,252,901 A 10/1993 Ozawa et al.
5,255,753 A 10/1993 Nishikawa et al.
5,295,893 A 3/1994 Chiu
5,318,471 A 6/1994 Glovier
5,337,235 A 8/1994 Takahashi et al.
5,355,064 A 10/1994 Yoshino et al.
5,426,586 A 6/1995 Ozawa
5,455,497 A 10/1995 Hirose et al.
5,513,106 A 4/1996 Yoshino et al.
5,545,960 A 8/1996 Ishikawa
5,545,967 A 8/1996 Osborne et al.
5,842,533 A 12/1998 Takeuchi
5,870,527 A 2/1999 Fujikawa et al.
5,892,346 A 4/1999 Moroto et al.
5,929,585 A 7/1999 Fujita
5,963,663 A 10/1999 Tani
5,963,712 A 10/1999 Fujita et al.
6,210,249 B1 * 4/2001 Stadlbauer ..... 446/330
6,238,264 B1 * 5/2001 Kazami et al. ..... 446/356
6,488,560 B2 * 12/2002 Nishikawa ..... 446/356

* cited by examiner

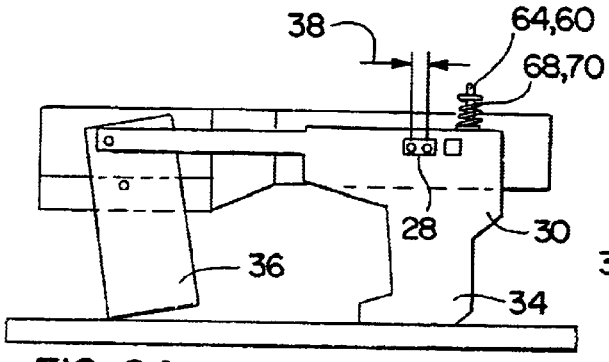
FIG. 2A
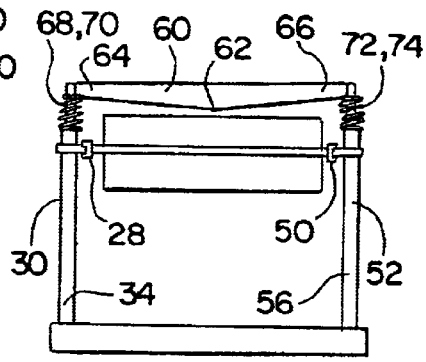
FIG. 2B
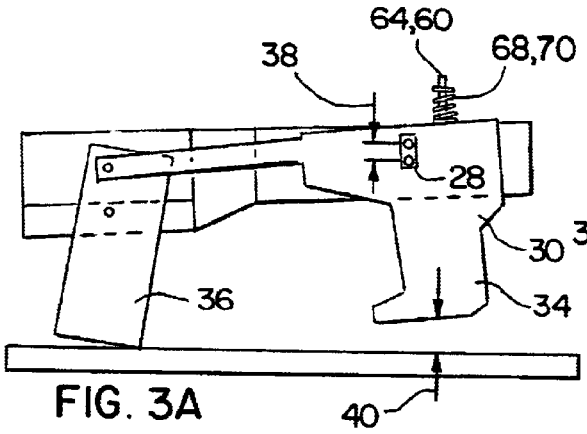
FIG. 3A
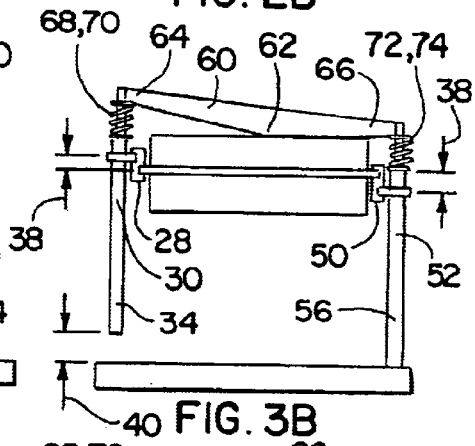
FIG. 3B
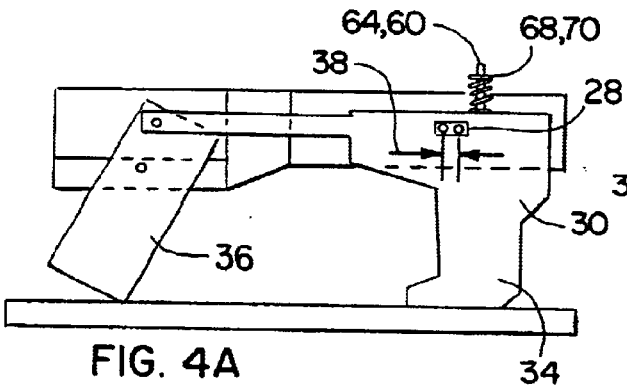
FIG. 4A
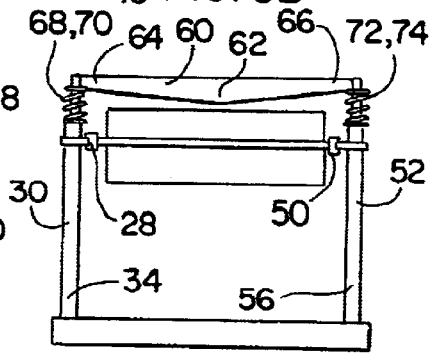
FIG. 4B
FIG. 5A
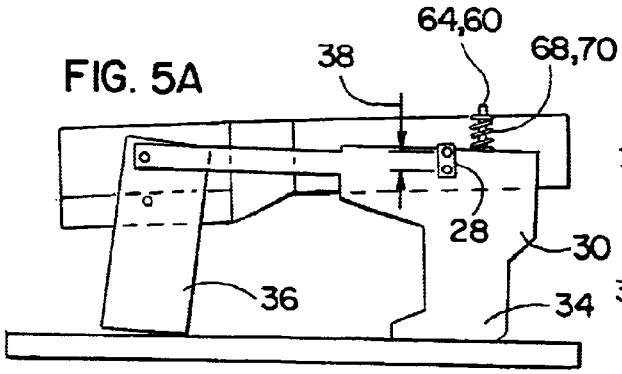
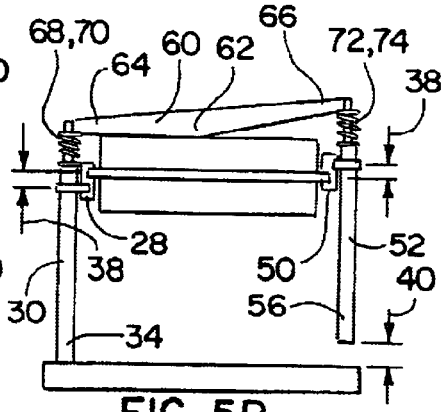
FIG. 5B

| | TASKS | MECHANICAL | ELECTRONIC | SOFTWARE |
|---|---|---|---|---|
| SENSORS & OUTPUT | VR | MIC PLACEMENT | MIC TYPE / PRE AMP | VR PROCESSING W/INT |
| | SOUND SOURCE | MIC PLACEMENT | MIC TYPE/PRE AMP | DF PROCESSING W/ INT |
| | LIGHT | CELL PLACEMENT | I/O LINES | LIGHT LEVEL |
| | CURRENT | | AMP | CURRENT LEVEL W/ INT |
| | TILT | | I/O LINE | POSITION W/INT |
| | IR WALL OBJECT | PLACEMENT / WINDOW | LED DRIVER<br>IR DETECTOR COM-PAT | LED MUXING<br>COM PROTOCAL<br>OBJECT/OBSTACLE W/INT |
| | BODY SW | PLACEMENT | I/O LINE | SWSCAN WITH INT |
| | EYES | PLACEMENT/ | LED DRIVER | EYE DRIVER |
| | AUDIO OUTPUT | PLACEMENT<br>QUALITY | SPEAKER TYPE<br>VOICE IC ?<br>AMP ? | SPEECH SYN OR SPEECH TRIG |
| MECHANICAL | LEGS | MECH / MOTOR / MOBILITY<br>REL/QC ISSUES<br>CURRENT DRAW | MOTOR DRIVER<br>POSITION SENSING | DIRECTIONAL CONTROL |
| | HEAD & TAIL | ANIMATION<br>REL / QC<br>CURRENT DRAW | MOTOR DRIVER<br>POSITION SENSOR | ANIMATION CONTROL |
| | POWER SUPPLY | POSITION<br>PACKAGING | SIZE / TYPE<br>VOLTAGE LEVEL | POWER MANAGEMENT |
| | BEAUTY | DESIGN | PCB ASSEMBLY | |
| SOFTWARE | | RESET SW<br>MODULE PLACEMENT | RESET SW<br>MODULE SOCKET<br>CPU(S) ?<br>VOICE CHIP ? | |

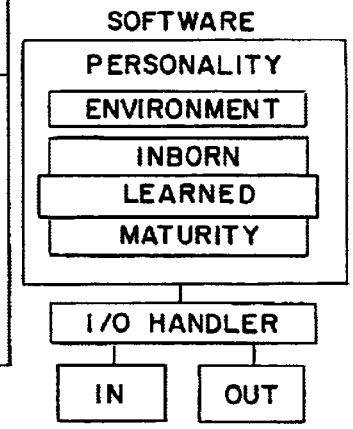

FIG. 11

POWER SUPPLY & MOTORS
MOTOR-1A
MOTOR-1B
MOTOR-2A
MOTOR-2B
MOTOR-3A
MOTOR-3B
VCC
VCC1
9V
VCC3
POWER CTRL
GND

VCC
VSS
RESET
IO C0
IO C1
IO C2
IO C3
IO B5
IO B4
IO B1
IO B0
IO D0
IO D1
IO D2
IO D3
IO D4
U2
IA3
IA2
IA1
IA0
VSS
VDD
VDO
OSC 0
OSC 1
AUD A
AUD B
TEST
IO D7
IO D6
IO D5
POWER CTRL
MOTOR-1B
MOTOR-1A
MOTOR-2B
MOTOR-2A
MOTOR-3B
MOTOR-3A
A
B
C
D
E
TO FIG. 13B
F
G
H
J
K
TO FIG. 13B
VCC3
VCC3
X1

SELF-PHASE SYNCHRONIZED WALKING AND TURNING QUADRUPED APPARATUS

CROSS REFERENCE TO RELATED APPLICATION

This application claims benefit of U.S. Provisional Application No. 60/255,974, filed Dec. 15, 2000.

BACKGROUND OF THE INVENTION

1. Field of the Invention

The invention relates to quadruped walking platforms that achieve synchronized walking and turning and, more particularly, to quadruped walking platforms that achieve self-phase synchronized walking and turning by using a damper mechanism and a phase lock bar.

2. Description of the Related Art

There are numerous examples in the prior art of walking devices that use a single motor that is coupled to a single crank shaft which in turn drives the two rear limbs that are also connected to two front limbs. The crank shaft typically has two crank throws that have a phase differential of 180 degrees between them with each of the throws rotatably connected to the corresponding rear limb. As a result, the motor causes one side of legs to thrust while the other side is planting, thereby mimicking the walking of a four-legged animal.

These devices can walk in a forward manner when the motor is rotating in that direction. In the alternative, these devices can walk in a reverse direction when the motor is reversed. Although these prior art devices can walk effectively, they are still unsatisfactory for at least two reasons. One problem with these devices is that they lack the ability to alter the phase differential between the left and right sets of limbs. Moreover they may not be able to restore the original phase differential once it has been disturbed. Therefore, these devices lack the ability to turn and to truly mimic the walking motion of a four-legged animal. Likewise, these devices lack the ability to turn on axis. As a result of these deficiencies, these devices cannot avoid obstacles or seek out objects in their environment.

A prior solution for this problem is the use of multiple motors, (e.g., twelve or more motors), that are under servo control from a computer. In these devices, the servo/computer generates the phase and sequence that the motors on the limbs must achieve to walk successfully. This solution can be cost prohibitive because of the need for many motors, a servo, and a computer as well as its inherent complexity. Accordingly, there exists an unfulfilled need for a quadruped apparatus that can turn both conventionally and on axis in a way that is more cost effective than any method taught by the prior art.

A second problem with these prior art devices is that they do not interact with their environment or make other non-ambulatory movements in a manner that resembles animals. Their inability to turn contributes to this problem because they can not interact with their environment because they are unable to alter their course in response to stimuli. In addition, these platforms frequently have only one motor that powers the walking motion of the devices. Therefore, they lack the source of power to create non-ambulatory movements such as moving their head toward a movement taking place around them, rendering them unlike animals. This can be disadvantageous in the robotic and toy fields where the goal is to have a device that is as similar to animals as possible. Accordingly, there exists a further need for a quadruped apparatus that can interact with its environment by turning or making non-ambulatory responses to stimuli.

SUMMARY OF THE INVENTION

In accordance with the present invention, a walking apparatus is provided that includes the ability to turn, both conventionally and on axis, and to respond to stimuli in its environment. This is achieved by providing a rapid and effective way to disturb and restore lateral phase differential from the limbs on one side of the apparatus to the other. The result is an apparatus that can turn in a conventional manner when both sets of limbs are moving in the same direction while also being able to turn on axis when both sets of limbs are moving in opposite directions. In addition, the invention provides a means for simple interface and control by a computerized apparatus so that it can process input signals from its environment, choose an appropriate response, and then execute that response. These features render the apparatus more like animals than those devices found in the prior art. Consequently, these apparati can be used in a wide variety of applications ranging from toys to advertising, to robotics, and to remote control devices.

One embodiment of the invention includes a first motor that is attached to the apparatus and is in communication with a first limb. This embodiment also includes a second motor attached to the apparatus that is independent from the first motor. It is in communication with a second limb that is capable of moving at a different rate than the first limb. Next, at least one damper mechanism is interposed between the first limb and the second limb, or other movable components mechanically linked thereto, which typically have a phase differential of 180 degrees between them, such that the damper mechanism will supply force to resist any change in the phase differential between these limbs. This damper mechanism may take the form of a simple torsion spring, but may comprise of other devices that are readily apparent to those skilled in the art such as brakes, clutches, compression springs, piston assemblies, etc. Thus, the phase differential will be maintained unless some force overcomes the force exerted by the damper mechanism.

The apparatus may be powered electrically, chemically, by solar power, etc. to cause the first and second motors to rotate their respective drive shafts. This energy is then mechanically transmitted to the first and second limbs causing them to make a stepping motion. Since the motors and limbs are independent from each other, a regulator may be used in conjunction with these motors so that their speed may be altered with respect to each other, thereby disturbing the phase differential originally established between them by overcoming the force exerted by the damper mechanism. The end result is that one limb will move faster than the other, causing the apparatus to turn in a prescribed radius. Once the force controlled by the regulator is removed from the motor, the force exerted by the damper mechanism will restore the original phase differential until both the first and second limbs are moving at the same rate causing the apparatus to walk in a straight line. Since this embodiment has only two legs, it may also have two wheels so that the apparatus will more closely resemble a quadrupedal animal. As can be seen, this invention provides a more efficient, simple, and cost effective way of providing an apparatus that can turn to seek out an object such as a ball or avoid an obstruction such as a mountain or a chasm than prior art devices.

BRIEF DESCRIPTION OF THE DRAWINGS

FIG. 2A is left elevational view of the apparatus as it is thrusting forward during its walking sequence;

FIG. 2B is a rear elevational view of the apparatus as it is thrusting forward during its walking sequence;

FIG. 3A is a left elevational view of the apparatus as it is transferring opposite during its walking sequence;

FIG. 3B is a rear elevational view of the apparatus as it is transferring opposite during its walking sequence;

FIG. 4A is a left elevational view of the apparatus as it is setting its front leg while walking;

FIG. 4B is a rear elevational view of the apparatus as it is setting its front leg while walking;

FIG. 5A is a left elevational view of the apparatus as it is transferring same during the walking sequence;

FIG. 5B is a rear elevational view of the apparatus as it is transferring same during the walking sequence;

FIG. 11 shows how the sensors, output components, mechanical components, and software work together to allow the apparatus to interact with its environment;

DESCRIPTION OF THE PREFERRED EMBODIMENTS

Figure 1A:
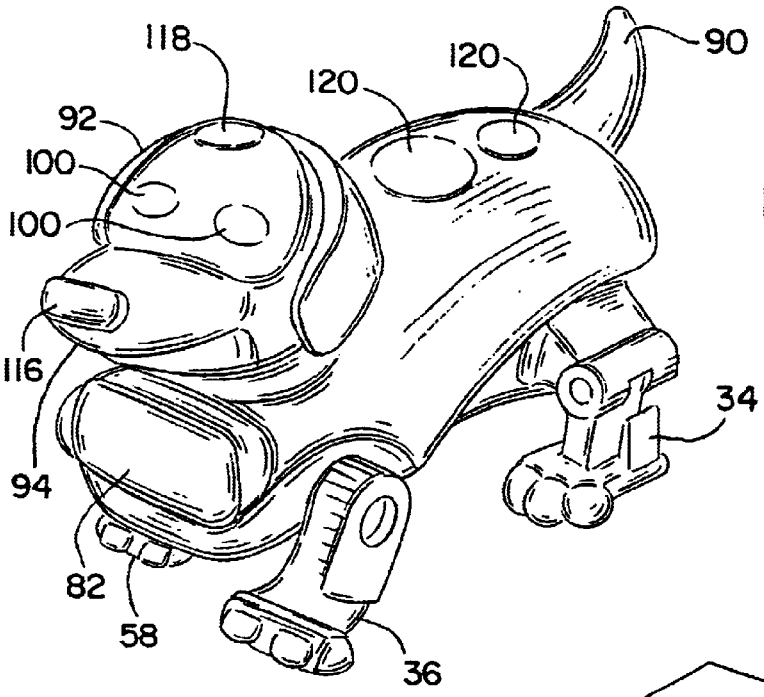
FIG. 1A is a perspective view of a quadrupedal and fully canine apparatus that can walk toward objects using an infrared sensor.
Figure 1B:
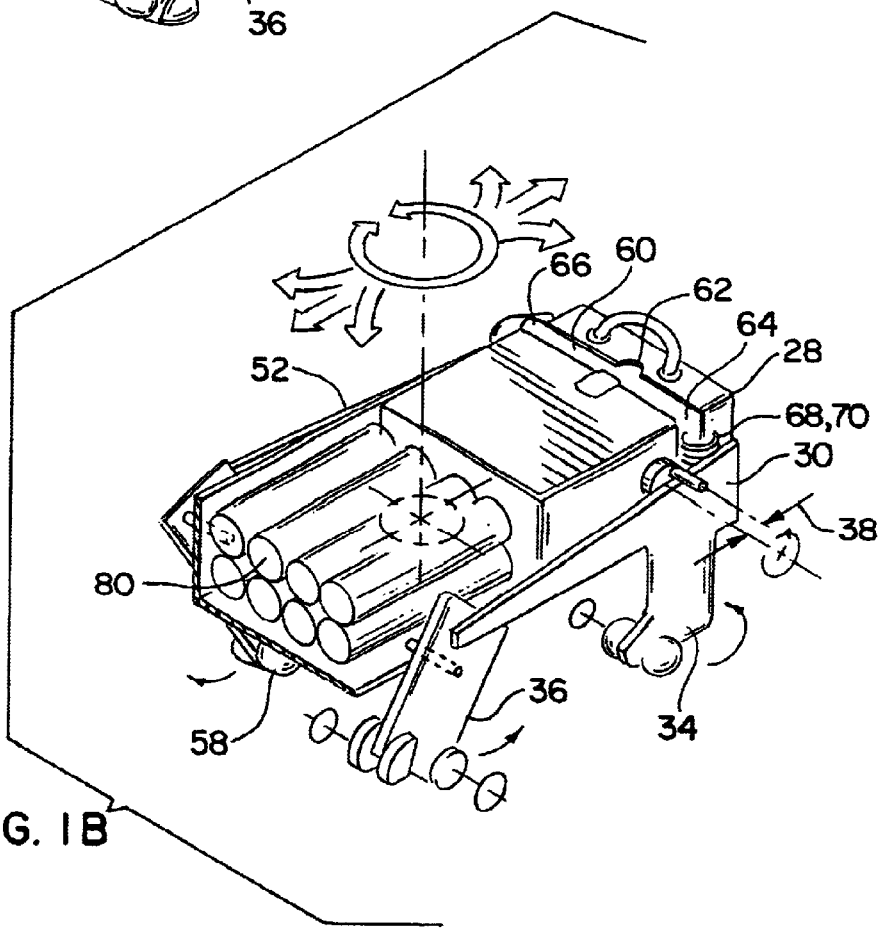
FIG. 1B is a perspective view of the quadrupedal apparatus showing its main ambulatory components.
Figure 1C:
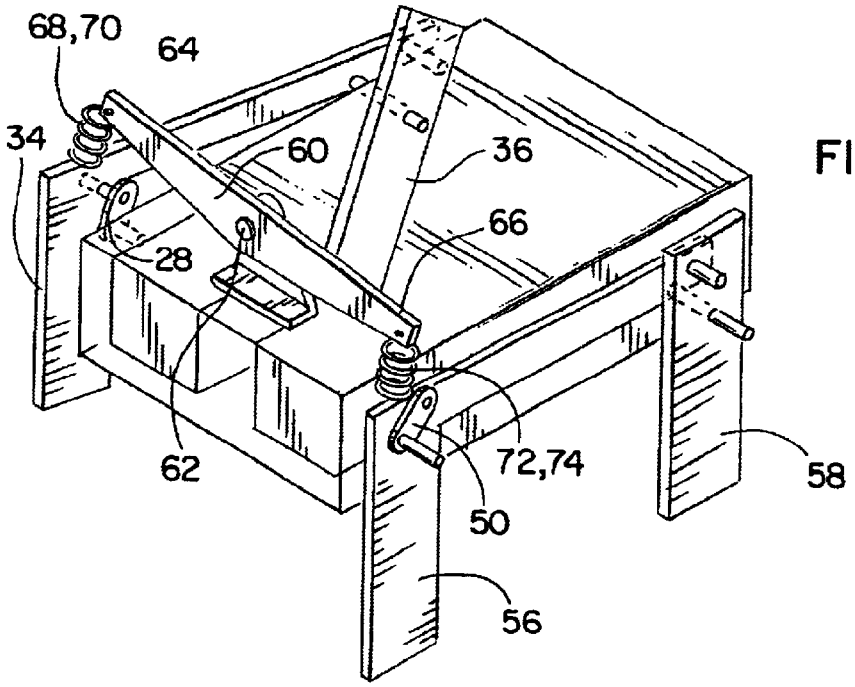
FIG. 1C is a perspective view of the quadrupedal, canine walking apparatus showing how the damper mechanism works.
Figure 1D:
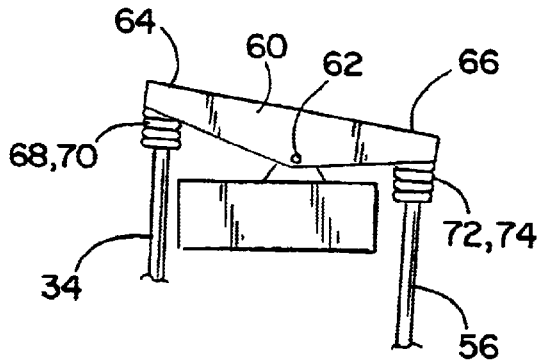
FIGS. 1D and 1E illustrate the damper mechanism operation with phase regulation using compression springs.
Figure 1E:
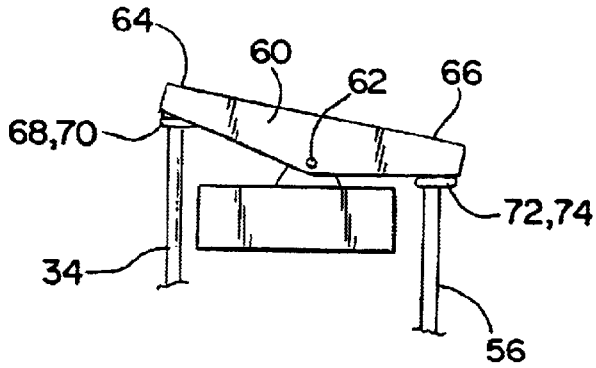

Referring to FIGS. 1A–8H, the preferred embodiment of the present invention is one that is quadrupedal and is fully canine. This embodiment includes a first motor 20 within the rear portion of the apparatus that has a drive shaft 22 extending therefrom. Fixedly attached to the drive shaft 22 of the first motor is the first gear 24 of the first gear train. This gear meshes with a second gear 26 of the first gear train that is larger and is mechanically coupled to the first crank shaft 28. The difference of the relative sizes of these gears increases the torque supplied by the motor to the limbs in order to improve its ability to drive the apparatus. Of course, multiple gears may also be interposed between the first gear 24 and second gear 26 of the first gear train in order to achieve the exact torque amplification that is desired. Next, the first crank shaft 28 is rotatably and eccentrically attached to the first bell crank 30. Anywhere between the first bell crank 30 and the first motor 20, there may be a first clutch 32 positioned such that if one of the legs mechanically linked to the first motor 20 becomes entangled and unable to move, then the first motor 20 will be disengaged from the limbs, thereby avoiding damage to the first motor 20. The lower portion of the first bell crank 30 serves as a first rear limb while its other end is rotatably attached to the first front limb 36. The first front limb 36 is also rotatably attached to the apparatus with the axis of rotation of that attachment being eccentric to the axis of rotation of the attachment to the first bell crank 30.

Consequently, the motion of the first motor 20 is communicated through these components and results in a stepping motion of the first front limb 36 as it swings back and forth. It is readily apparent to those skilled in the art that this communication could also be accomplished through the use of belts, chains, linkages, etc. The first rear limb 34 makes tiny circles which causes it to also make a stepping motion at the same time the first front limb 36 is moving because dorsal phase differential is maintained by the mechanical coupling of the first front limb 36 to the first rear limb 34. The radius of this circle is equal to the eccentricity 38 of its rotatable attachment to the first bell crank 30 and determines the height of the step 40 for the apparatus.

The present preferred embodiment also includes a second motor 42, independent of the first motor 20, that is within the rear portion of the apparatus and has a drive shaft 44 extending therefrom. Fixedly attached to the drive shaft 44 of the second motor is the first gear 46 of the second gear train. This gear meshes with a second gear 48 of the second gear train that is larger and is mechanically coupled to the second crank shaft 50 which can be oriented to any phase with respect to the first crank shaft 28. As mentioned above, the difference of the relative sizes of these gears increases the torque supplied by the motor to the limbs in order to improve its ability to drive the apparatus. Again, multiple gears may also be interposed between the first gear 46 and second gear 48 of the second gear train in order to achieve the exact torque amplification that is desired. Next, the second crank shaft 50 is rotatably and eccentrically attached to the second bell crank 52. Anywhere between the second bell crank 52 and the second motor 42, there may be a second clutch 54 positioned such that if one of the legs mechanically linked to the second motor 42 becomes entangled and unable to move, then the second motor 42 will be disengaged from the limbs, thereby avoiding damage to the second motor 42. The lower portion of the second bell crank 52 serves as a second rear limb 56 while its other end is rotatably attached to the second front limb 58. The second front limb 58 is also rotatably attached to the apparatus with its axis of rotation being eccentric to the axis of rotation of the attachment to the second bell crank 52.

As a result, the motion of the second motor 42 is communicated through these components, independent of the motion of the first front 36 and first rear 34 limbs and with a phase differential, and results in a stepping motion of the second front limb 58 as it swings back and forth. As noted above, this communication could also be accomplished through the use of belts, chains, linkages, etc. The second rear limb 56 makes tiny circles which causes it to also make a stepping motion at the same time the second front limb 58 is moving because dorsal phase differential is maintained by the mechanical coupling of the second front limb 58 to the second rear limb 56. The radius of this circle is equal to the eccentricity 38 of its rotatable attachment to the first bell crank 30 and determines the height of the step 40 for the apparatus. Preferably, the components and dimensions of the left side of the apparatus match those of the right side, thereby ensuring symmetry which helps the apparatus to maintain balance and closely resemble a canine while it walks.

An advantageous feature of the preferred embodiment is a phase lock bar 60 that is rotatably attached to the apparatus at a pivot point 62 near the top, rear, and center of the apparatus. Preferably, the length of the phase lock bar is symmetrical about this pivot point 62 such that its first end 64 slightly overhangs the first bell crank 30 while its second end 66 slightly overhangs the second bell crank 52. Interposed between the first end 64 of the phase lock bar and the first bell crank 30 is a first damper mechanism 68 which may take the form of a first compression spring 70. Symmetrically, a second damper mechanism 72 including a second compression spring 74 may also be interposed between the second end 66 of the phase lock bar and the second bell crank 52. It is preferred to use two springs so that the length of the springs and their spring constants may be optimized so when phase is achieved they are relaxed and at maximum compression when phase slips beyond compensation. This modality for the springs is true for all states of forward, reverse, turn on radius and turn on axis.

The resulting structure is capable of maintaining a normal 180 degree phase differential between the left and right sides for forward and reverse. The resulting structure is also capable of maintaining a nominal sliding phase differential between the left and right sides for radius turns. Finally, the resulting structure is capable of maintaining a 90 degree counter phase differential between the left and right sides for axial turns. This structure of the apparatus also continually compensates against minor variances caused by the motors or the surroundings binding or dragging on the apparatus. This is achieved by way of the phase lock bar 60 which acts as an vertical differential oscillating regulator or a "see-saw" as it follows the vertical vector motion of the bell cranks up and down relative to each other. The phase bar 60, equally distribute retarding forces via the springs 70 and 74, to both motors forcing them to constantly seek the nominal phase for the particular regime of walking. If the timing is upset by forcibly increasing the speed of the first motor 20 or second motor 42 by way of the first regulator 76 or second regulator 78, then the first 70 and second 74 compression springs begin to compress and exert force on the first 30 and second 52 bell cranks, retarding or dampening any disturbing forces, until phase differential has been restored (see FIG. 1C).

When walking forward, the motors are out of phase at 180 degrees, the spring retarding force is essentially zero. At a 90 degree change of phase, the spring retarding force rises to that equal to walking friction. At 0 degrees phase differential, the spring force is at its highest at 4 times walking friction. This phase to retardation dampening force ratio is further enhanced by the fact that the lateral sequence of walking, left and right sides, is sensitive to the phase angle of the bell cranks. At plus or minus 20 degrees from nominal phase differential no effective walking motion, i.e., relative forward or turning motions will take place. The net result is as phase is lost relative motion is lost until phase is restored. This means that when the apparatus is disturbed, it will continually apply more torque to automatically correct phase despite the resisting force. This damping force will continue until zero phase or highest torque is achieved. If this fails to achieve correction the cycle repeats. When phase is restored normal motion will be restored. Without the phase lock bar 60, this apparatus is incapable of coherent motion and would simply oscillate in place with no relative motion. As can be seen, this invention thereby provides an apparatus with a unique, novel, and non-obvious method of walking and turning than found in the prior art.

FIGS. 2A and 2B show the position of the first rear limb 34, the first front limb 36, and the second rear limb 56 during the initial phase of the walking sequence of the apparatus. Initially, the rear limbs are planted flatly on the ground while the first front limb 36 is tilted slightly forward. Since the lateral phase differential is still at 180 degrees, neither the first compression spring 70 nor the second compression spring 74 are compressed. It should be noted that FIG. 2A shows only the position of the first front limb 36 and first rear limb 34 while the second front limb 58 and second rear limb 56 have been omitted for the sake of clarity.

FIGS. 3A and 3B show the second phase of the walking sequence of the apparatus. As can be seen, the first rear limb 34 begins to rise as the second rear limb 52 pushes down on the ground. Hence, the second rear limb makes a step with a height 40 equal to the eccentricity 38 of the connection of the first bell crank 30 to the first crank shaft 28. At the same time, the first front limb 36 swivels until it is leaning slightly backwards. Once again, FIG. 2B depicts that the lateral phase differential has been maintained at 180 degrees, resulting in no compression of either the first compression spring 70 or the second compression spring 74.

Turning to FIGS. 4A and 4B, it is clear that the first rear limb 34 is once more firmly and flatly planted upon the ground. Due to the rotation of the first bell crank 30, the first front limb 36 is tilted toward the rear at the most severe angle possible during the walking sequence of the apparatus while at the same time the position of the first rear limb 34 of FIG. 4A is located behind the position of the first rear limb 34 of FIG. 2A by a distance that equals twice the eccentricity 38 of the attachment of the first bell crank 30 to the first crank shaft 28. Since the first and second sides of the apparatus are symmetrical and have a 180 degree phase differential between them, it necessarily follows that when the first rear limb 34 and first front limb 36 are positioned as shown in FIG. 2A, then the second rear limb 56 and second front limb 58 are positioned as shown in FIG. 4A. This can be seen more clearly in FIG. 6B.

The last phase of the walking sequence is shown in FIGS. 5A and 5B. Here, the second rear limb 56 begins to rise while the first rear limb 34 is stationed firmly and flatly on the ground. As a result, the second rear limb 56 makes a step with a height 40 that is equal to the eccentricity 38 of the attachment of the second crank shaft 50 to the second bell crank 52. At the same time, the first front limb 36 is almost completely flat on the ground with just a slight tilt toward the rear of the apparatus. It also follows that as the first side of the apparatus is positioned as shown in FIG. 5A that the second side of the apparatus is positioned as shown in FIG. 3A because of the symmetry of the apparatus and the maintenance of the 180 degree phase differential between the two sides of the apparatus.

Figures 6A, 6B, 6C, 6D:
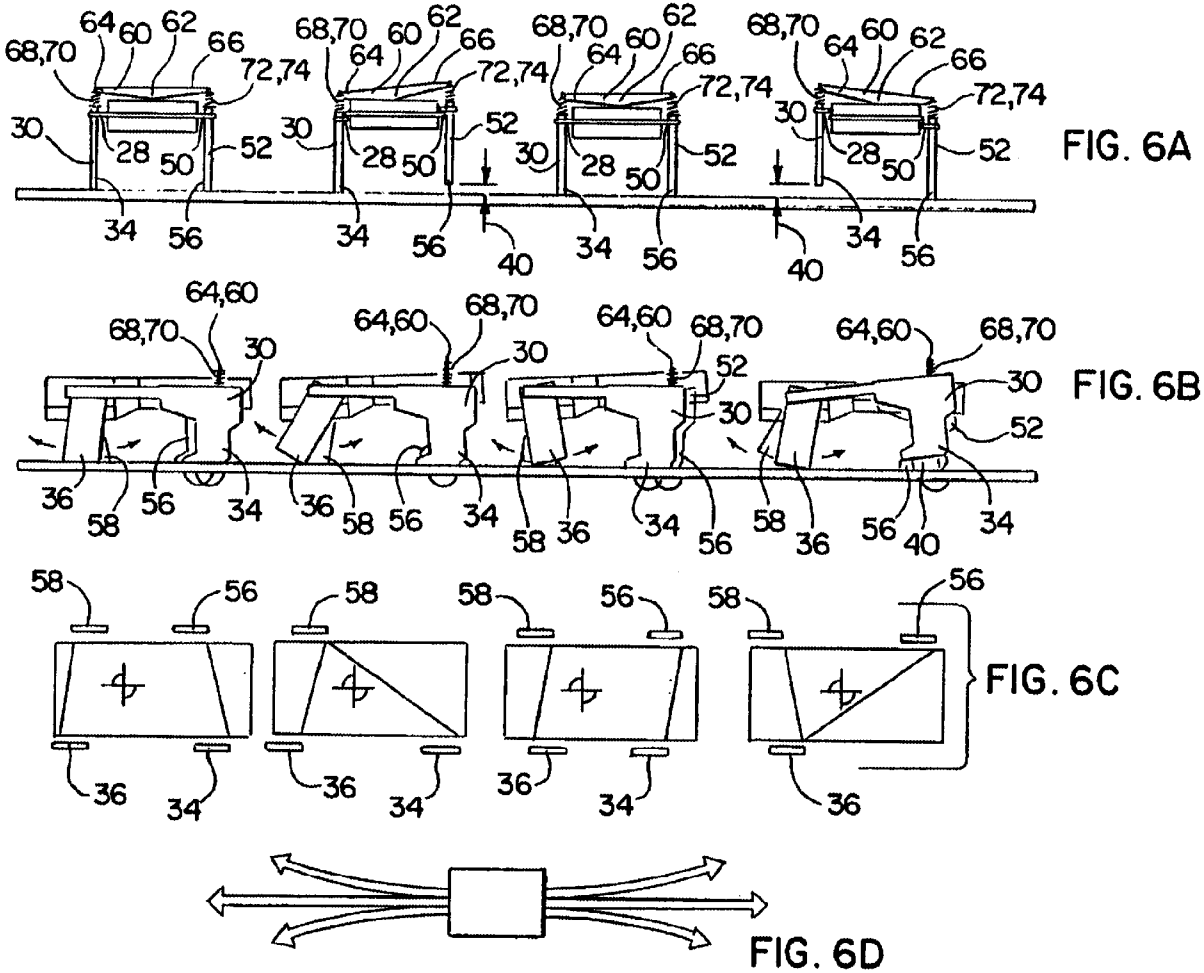
FIG. 6A is a walking motion chart showing the phase and sequence of the legs during its walking sequence.
FIG. 6B is a walking motion chart showing the phase and sequence of the legs during its walking sequence.
FIG. 6C shows the apparatus maintaining its center of balance within its stability envelope while walking.
FIG. 6D shows the apparatus' ability to walk forward, reverse, and to turn conventionally.
Figures 6E, 6F, 6G, 6H:
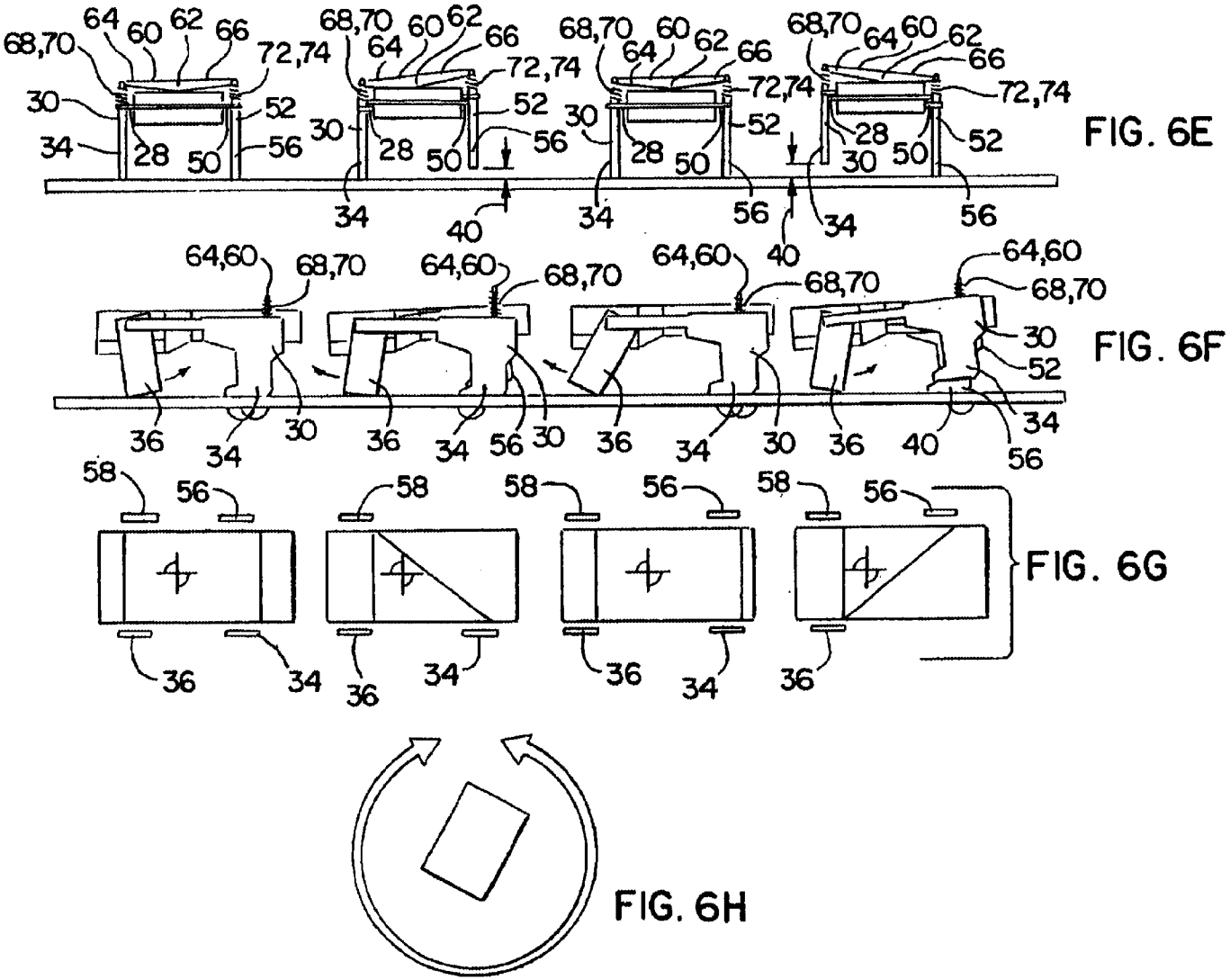
FIG. 6E is a rear view of the apparatus as it turns on axis.
FIG. 6F is a walking motion chart showing the phase and sequence of the legs while the apparatus is turning on axis.
FIG. 6G shows the apparatus maintaining its center of balance withing its stability envelope while walking.
FIG. 6H shows the apparatus' ability to turn on its axis.

FIG. 6A shows the order and placement of the different limbs as the apparatus walks in a radius turn. It should be noted that at certain times of the walking sequence that only three legs are in contact with the ground. This can cause the center of gravity of the apparatus to come dangerously close to the edge of the stability envelope of the apparatus and may cause the apparatus to topple. Consequently, it is preferable that sixty percent of the weight of the apparatus be located forward of the front legs of the apparatus. The batteries 80 used to power the motors of the apparatus should be located near the front of the apparatus in order to achieve this objective (see FIG. 7B). This can be facilitated by placing a battery compartment door 82 near the front of the apparatus for placing the batteries 80 in the front of the apparatus (see FIG. 1A). The additional weight of the batteries 80 near the front of the apparatus helps moves the center of gravity of the apparatus toward the front of the apparatus and further within the stability envelope of the apparatus when it is only supported by three limbs (see FIG. 1B). This, in turn, provides for a more stable apparatus while it is walking.

In addition, FIGS. 6B, 6C, and 6D show how this apparatus, using the walking sequence depicted by FIGS. 2A, 2B, 3A, 3B, 4A, 4B, 5A, and 5B, can walk forward, reverse, and turn left or right conventionally. When the first crank shaft 28 rotates in a counter clockwise direction and the second crank shaft 50 rotates in a clockwise direction, the apparatus walks in a forward direction. When these crankshafts are reversed, then the apparatus walks in a reverse direction. Finally, when either the first side or second side of the apparatus are sped up, the lateral phase differential of 180 degrees is disturbed and the sequences of the first side of the apparatus as shown in FIG. 6B are shifted with respect to the second side. Hence, the apparatus turns toward the direction of the slower moving side of the apparatus giving it the ability to turn in a prescribed radius.

FIGS. 6E, 6F, 6G, and 6H show how this embodiment of the present invention can execute a turn on its axis. First, the direction of one set of limbs is reversed with respect to the other set of limbs, thereby overcoming the force exerted by the first 70 and second 74 compression springs by forcibly reversing the direction of one of the motors. This is done until a counter phase of 90 degrees is achieved. At this point, the first front limb 36 and second front limb 58 should be in phase with each other while the first rear limb 34 and second rear limb 56 are 90 degrees out of phase. The motion of the legs will then cause the apparatus to turn on axis. Once the turning is complete, the force exerted by the reversed motor is removed until the force of the first 70 and second 74 compression springs causes the phase differential of the first bell crank 30 and second bell crank 52 to return to 180 degrees with both sets of limbs running in the same direction. After the original phase differential has been restored, the apparatus will walk again in a straight line. With all the aforementioned features, this apparatus can walk in a forward fashion, in a reverse fashion, turn left or right in a conventional manner, or turn on its axis. Changing walking patterns by phase shifting is usually accomplished in 1 rotation of the bell crank and takes under 0.5 seconds. Furthermore, phase restoration necessitated by friction, binding or obstruction of the apparatus also occurs within 1 revolution of the bell crank.

Figure 7A:
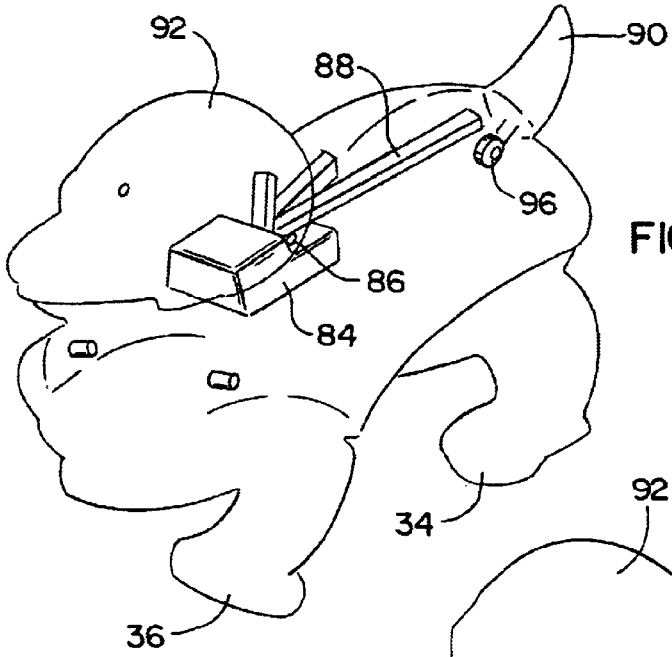
FIG. 7A is a perspective view of the apparatus showing its third motor which causes non-ambulatory movement.
Figure 7B:
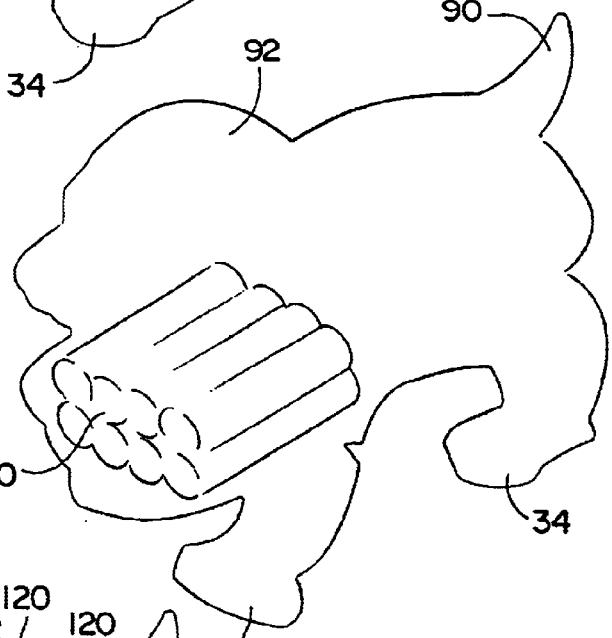
FIG. 7B is a perspective view of the apparatus showing the location of its batteries.

Another feature of this embodiment is that there is a third motor attached to the apparatus that is capable of providing power to the apparatus for non-ambulatory movement. Examples of such movement include wagging its tail 90, moving its head 92, sitting down, lying down, standing, and moving its mouth 94 (see FIGS. 8A–8H). Referring to FIG. 7A, an animation motor 84 and animation gears 86 are shown to give an example of how such movement can be accomplished. These components are connected by linkages 88 to the tail pivot point 96 which is connected to the tail 90. As the motor 84 drives the linkages 88, the tail will make a wagging motion. Similar setups can be provided for other types of movement so that this embodiment of the invention can more closely mimic canine attributes than prior art devices.

Figure 7C:
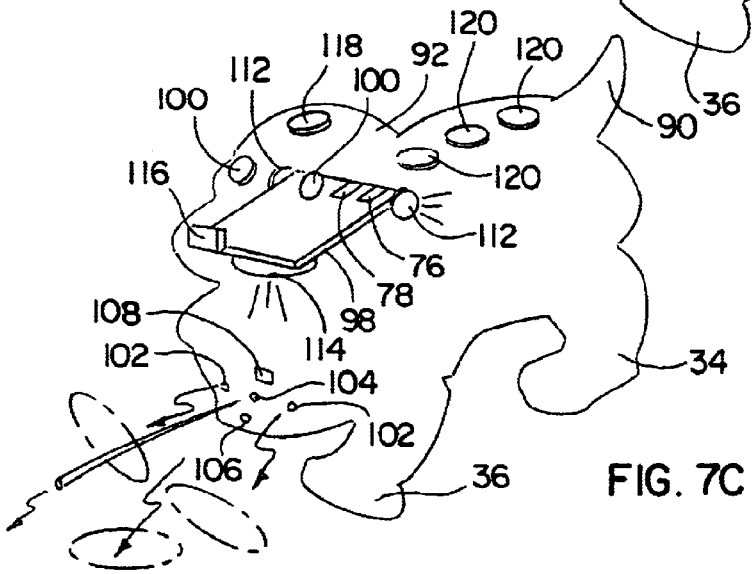
FIG. 7C is a perspective view of interactive components of the apparatus including pet switches, emitter LEDS, sensors, microphones, and a speaker.
Figure 7D:
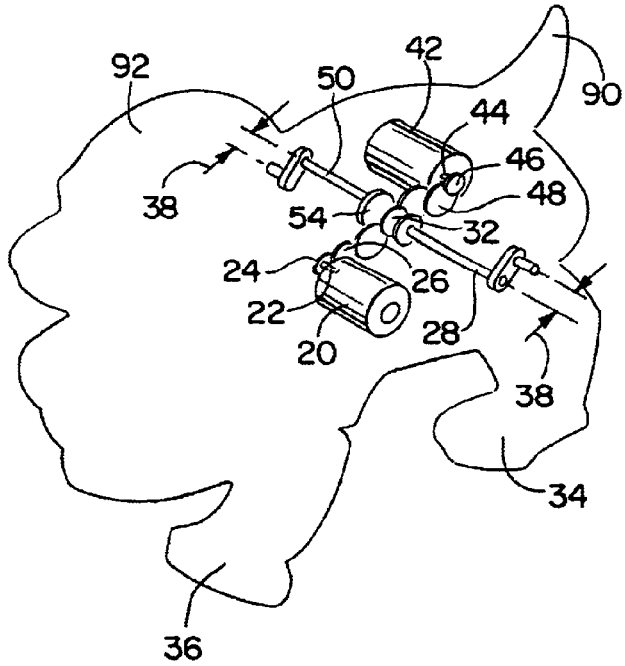
FIG. 7D is a perspective view of the apparatus showing its drive train assemblies.
Figure 8A:
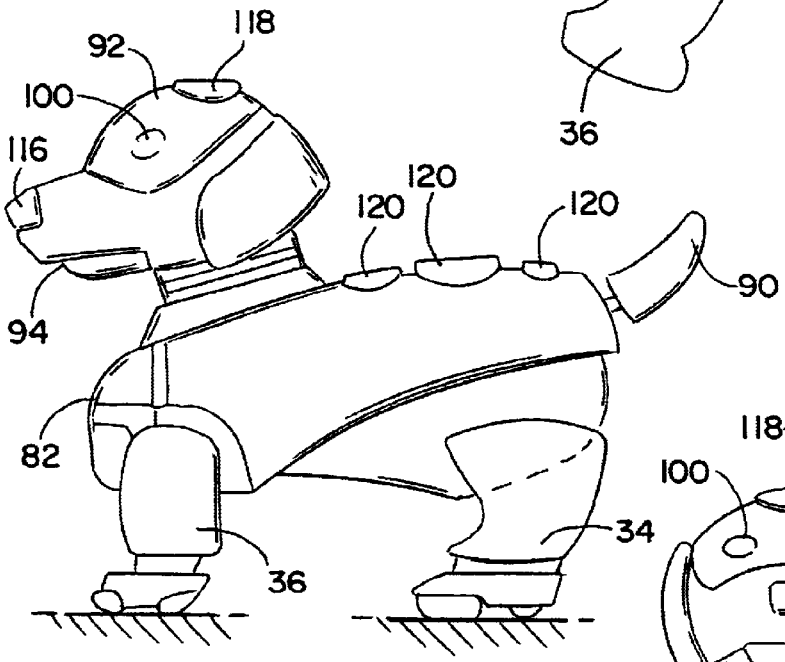
FIG. 8A is a left side elevational view of the apparatus.
Figure 8B:
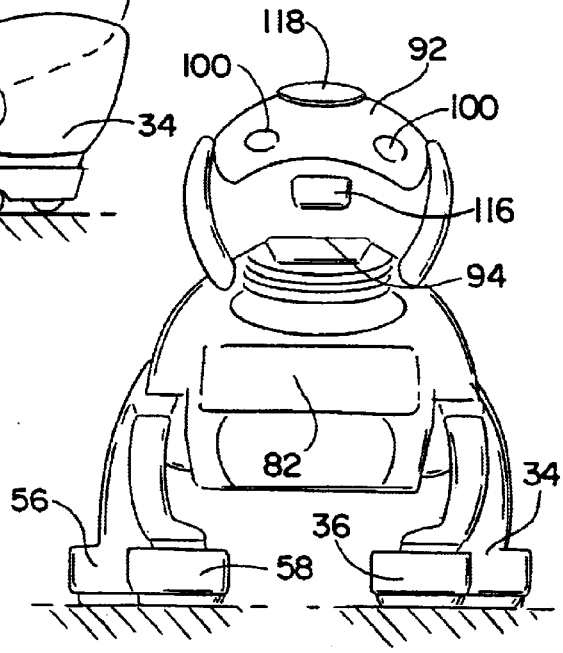
FIG. 8B is a front elevational view of the apparatus.
Figure 8C:
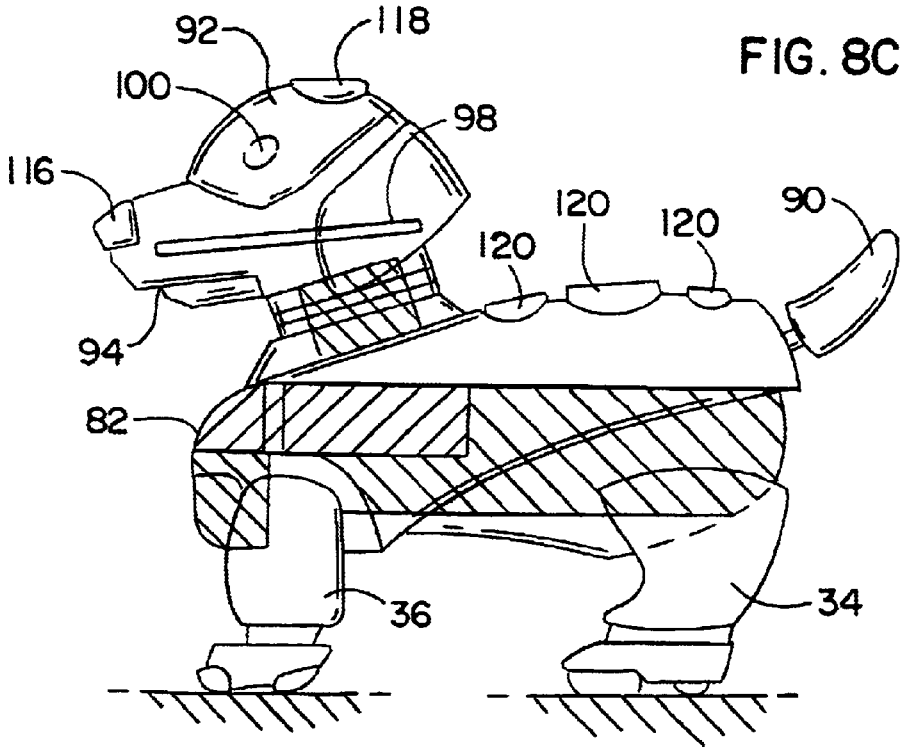
FIG. 8C is left cross-sectional view of the apparatus.
Figure 8D:
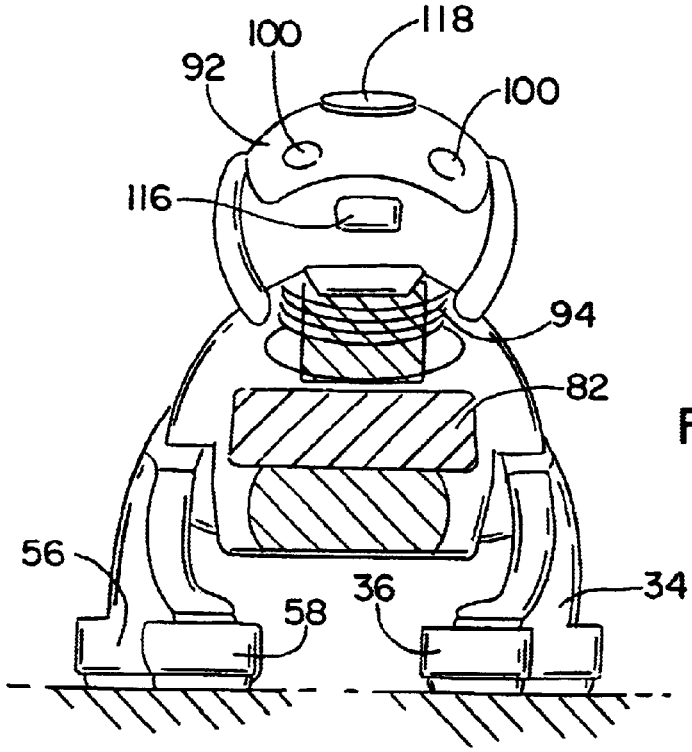
FIG. 8D is a front cross-sectional view of the apparatus.
Figure 8E:
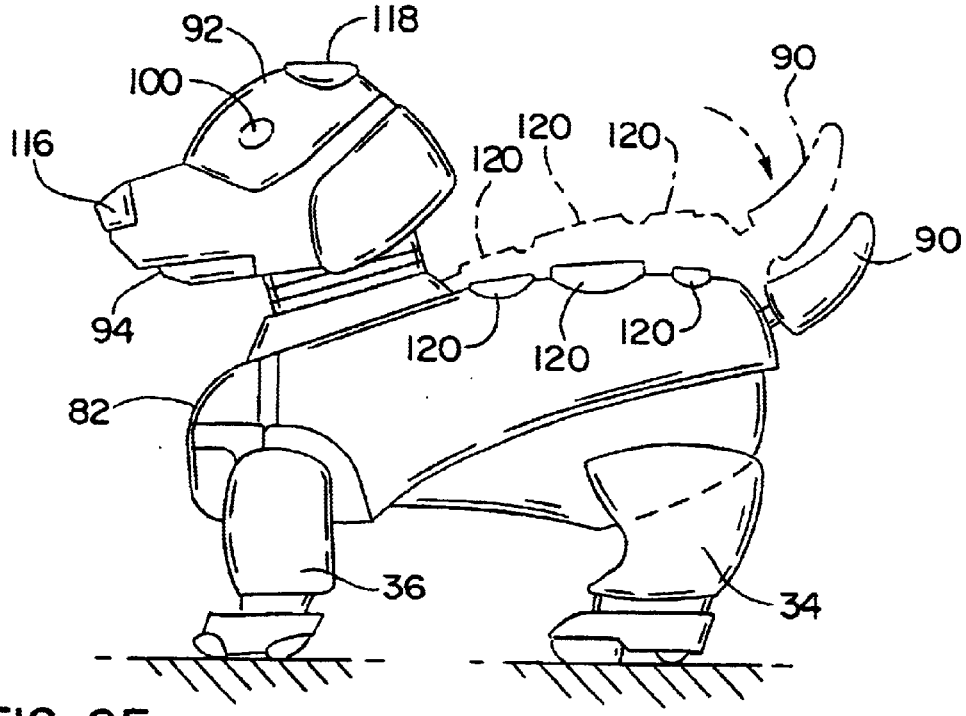
FIG. 8E is a left perspective view of the apparatus as it sits.
Figure 8F:
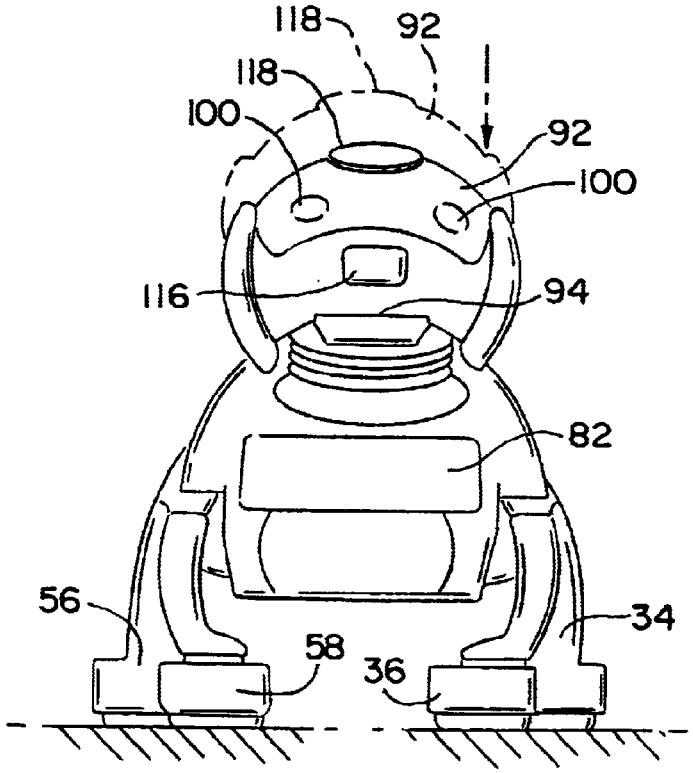
FIG. 8F is a front perspective view of the apparatus as it sits.
Figure 8G:
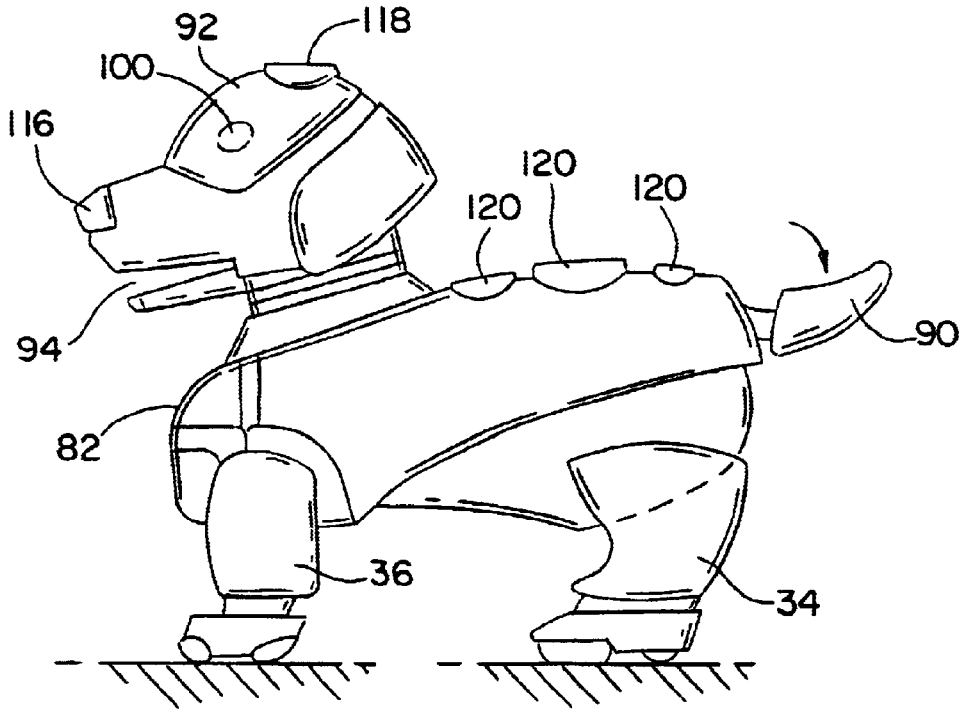
FIG. 8G is a left perspective view of the apparatus as it speaks and wags its tail.
Figure 8H:
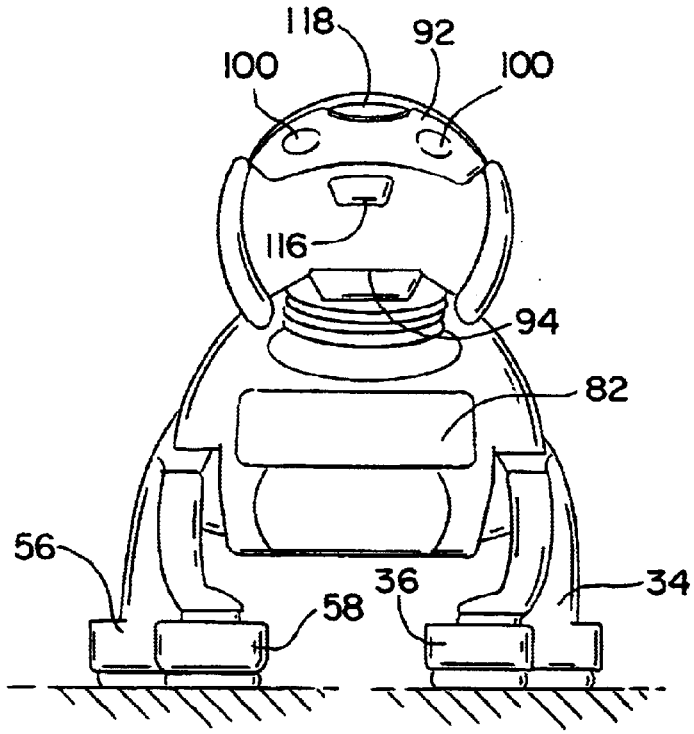
FIG. 8H is a front perspective view of the apparatus as it speaks and wags its tail.
Figure 12A:
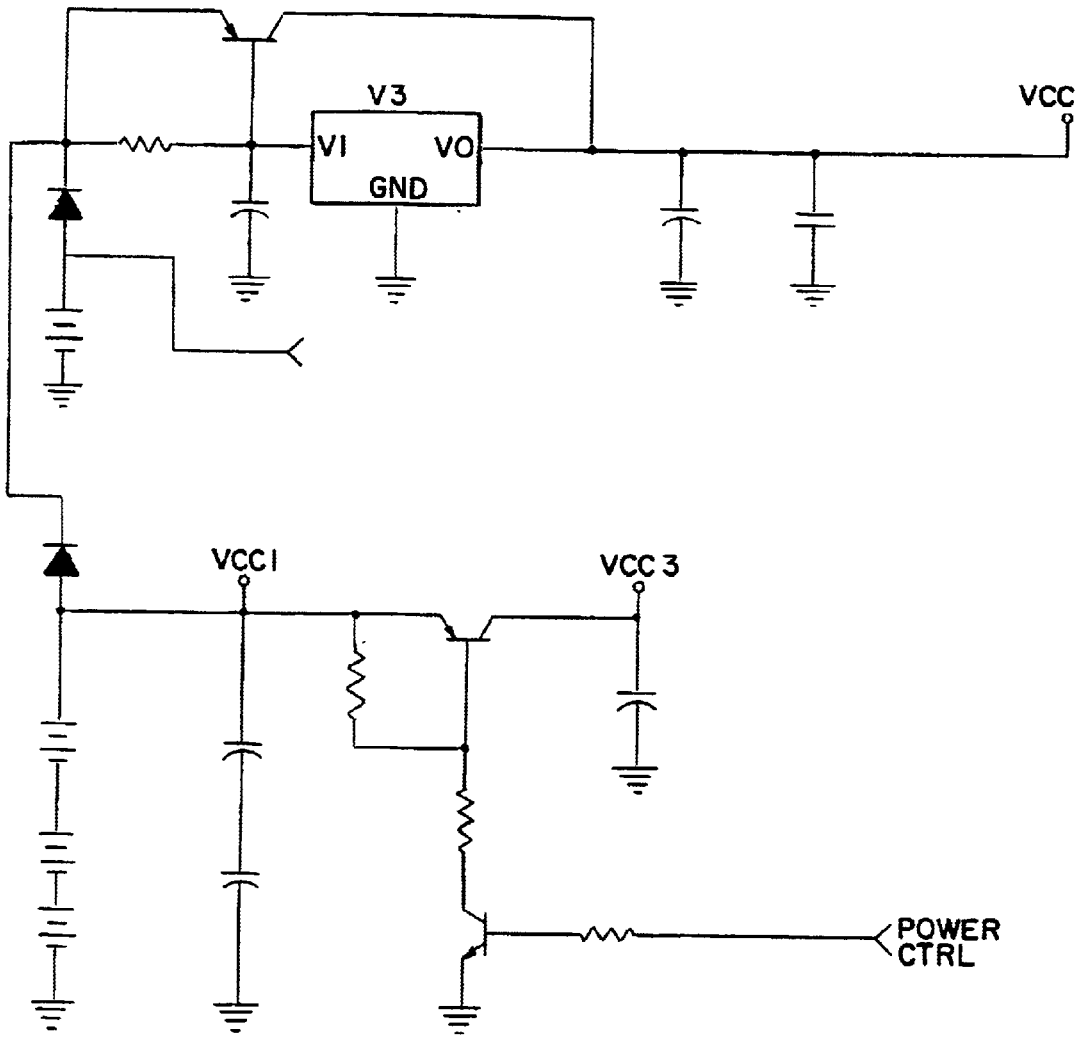
FIG. 12 shows a wiring schematic of the standard H bridge circuits that control the three motors.
Figure 12B:
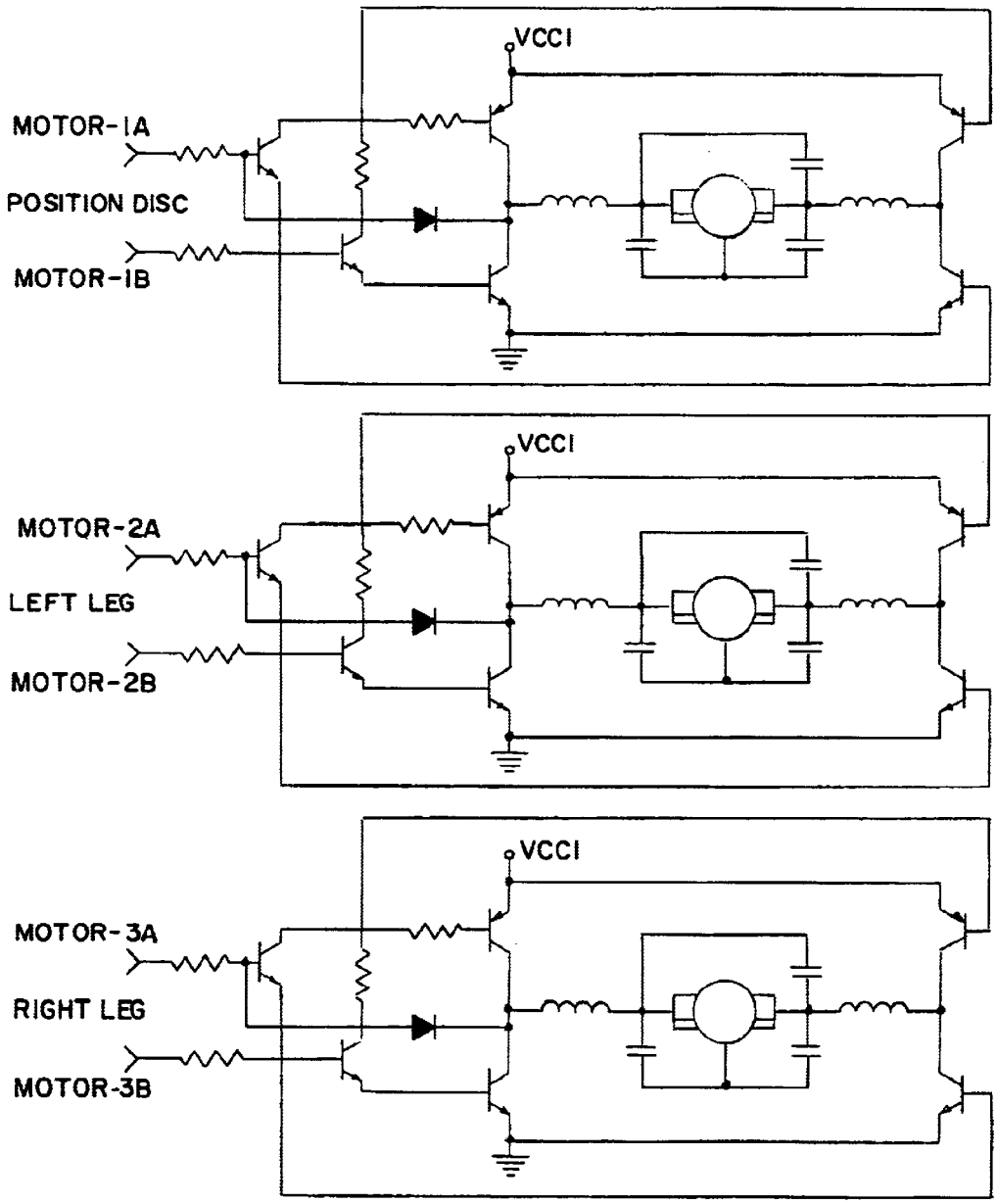

A possible variation of this invention is one in which the apparatus is controlled by a main board processor 98 that can process signals that communicate to the apparatus any stimuli found in its environment (see FIG. 7C). This may be accomplished by way of LED eyes 100, wall LEDS 102, an object LED 104, and a floor LED 106 that send out infrared transmissions which will bounce off objects, e.g., a moving ball, or detect chasms, e.g., a set of stairs, in its environment. The reflected signals are then picked up by a sensor 108 which transmits a corresponding signal to the main board processor 98. The main board processor 98 then decides whether there is a moving object present, such as a ball, that should be pursued or an obstruction that should be avoided. Next, the appropriate response is sent which will cause either the first 76 or second regulator 78, in the form of standard H bridge circuits (see FIG. 12), to speed up their respective motors, causing the apparatus to turn, conventionally or on axis, in the proper direction.

Another possible variation of this invention is one in which the apparatus is remotely controlled using a radio frequency transmission. The user could then simply use a remote controller, similar to those used for remote controlled model cars, to send a signal to the remote receiver telling it in which direction the user wishes the apparatus to turn. Then the remote receiver would cause either the first 76 or second regulator 78 to speed up the corresponding motor causing the apparatus to turn, conventionally or on axis, in the desired direction.

Yet another embodiment includes two microphones 112 that are placed on the head 92 of the apparatus where the ears of a dog would usually be. These microphones 112 can pick up noise in the apparatus' environment, such as the user's voice, to determine how the apparatus should move. This can be achieved when the signals from the microphones 112 reach the main board processor 98 which then decides whether the apparatus should pursue the sound or whether the sound itself is telling the apparatus in which manner or direction to move. Next, the main board processor 98 transmits the correct message which then tells one of the regulators to speed up or slow down to produce the desired movement. Often this version will also include a speaker 114 so that the apparatus can bark as it opens its mouth 94 in response to the user's voice or other sounds in its environment. In the case where the user's voice is used as a remote control, the user can tell the apparatus to walk, turn, stop, and bark.

Figure 9:
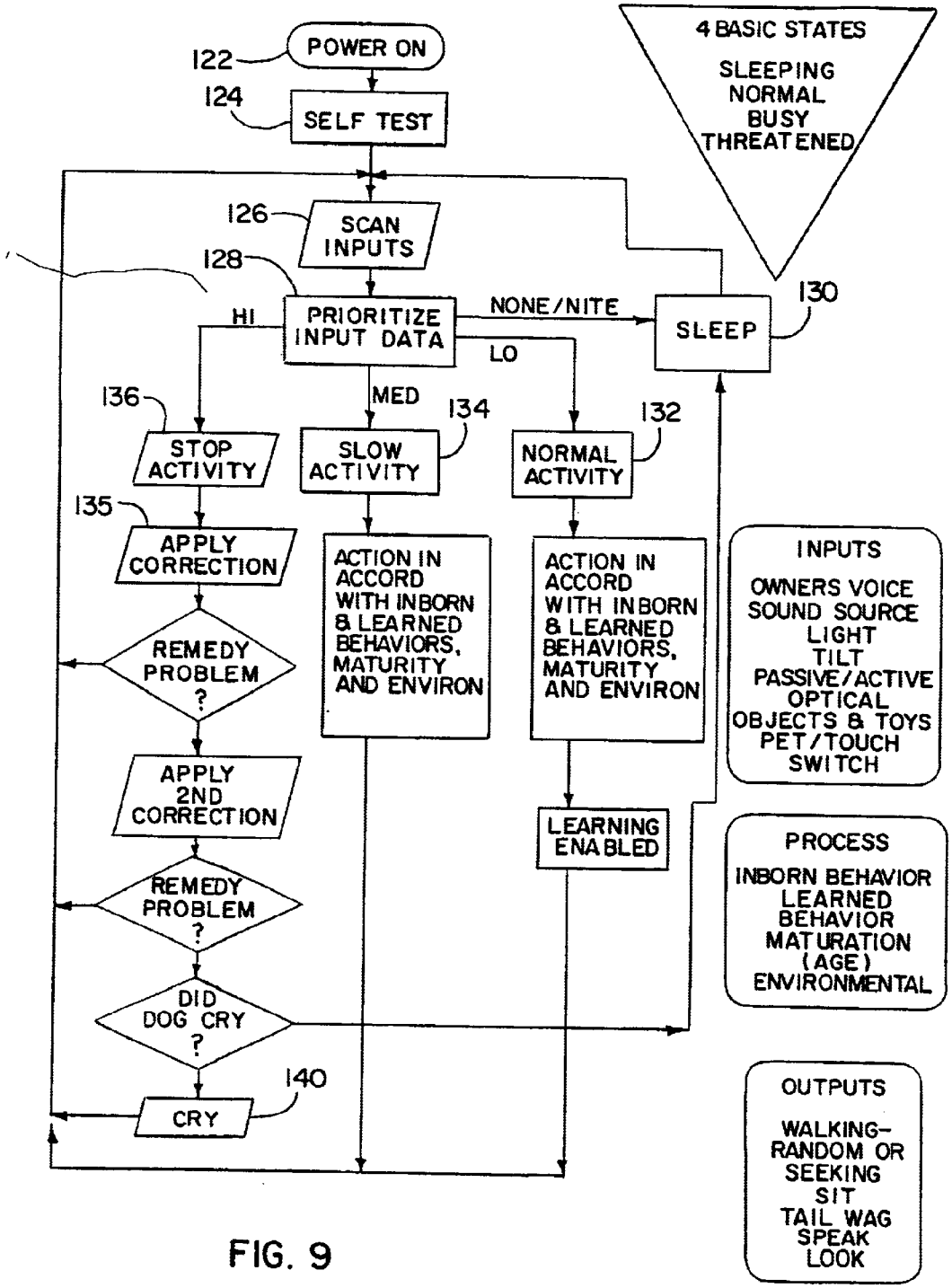
FIG. 9 is a high level flow chart showing how the apparatus responds to stimuli in its environment.

Referring to FIG. 9, the embodiment shown is capable of simulating different canine behaviors depending upon the stimuli found in its environment by implementing a high level flow chart. The first step in the flow chart is the power on step 122 that is initiated either by the user or by some type of timer. It is at this time that the apparatus resets all settings to their proper original values. The next step is the self-test 124 portion of the high level flow chart. During this step, the main board processor 98 checks all input devices to make sure that all systems are functioning properly. If not, the apparatus indicates a soft fail until the problem is rectified.

Figure 13A:
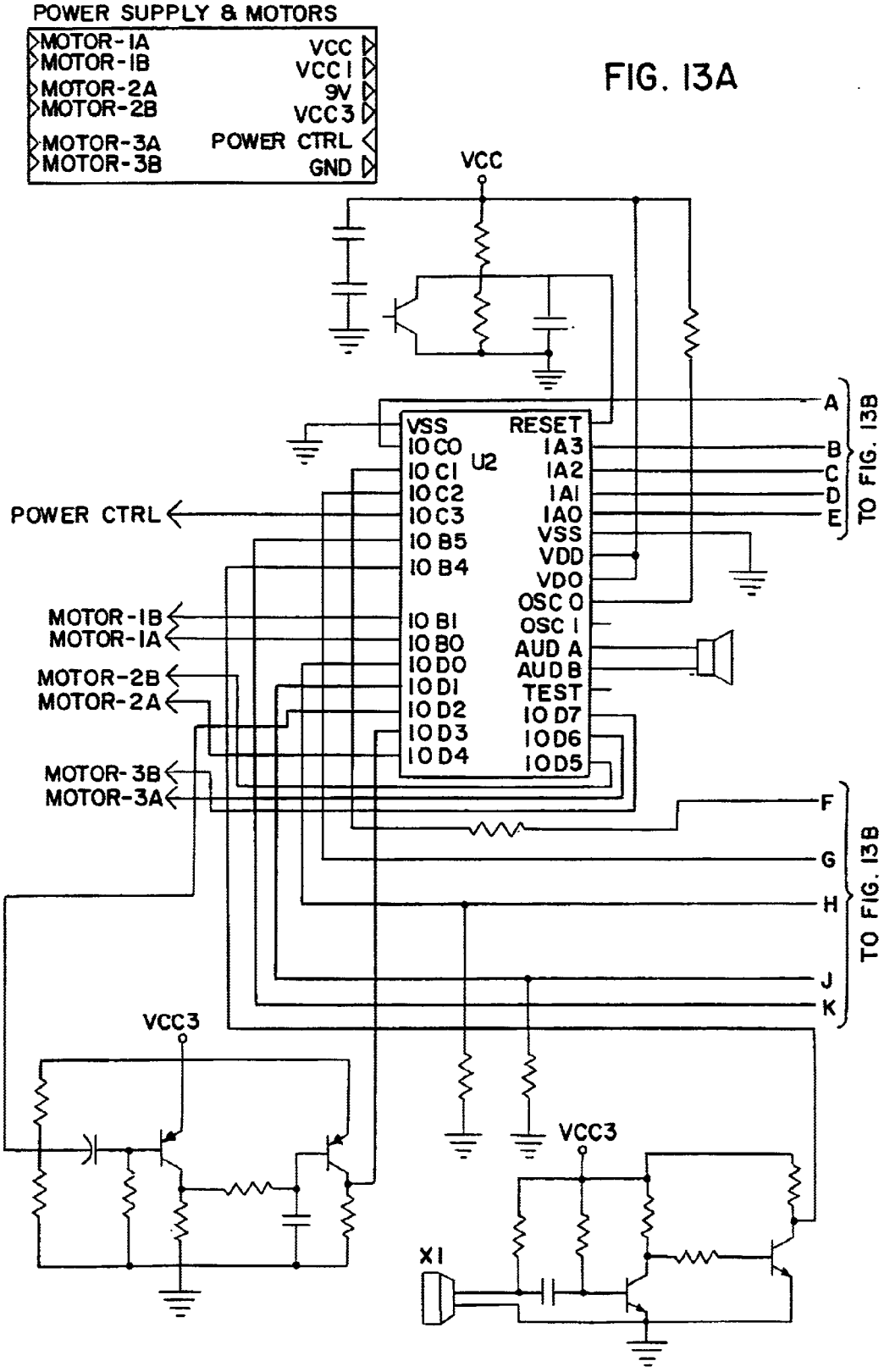
FIG. 13 shows a wiring schematic for the entire apparatus.
Figure 13B:
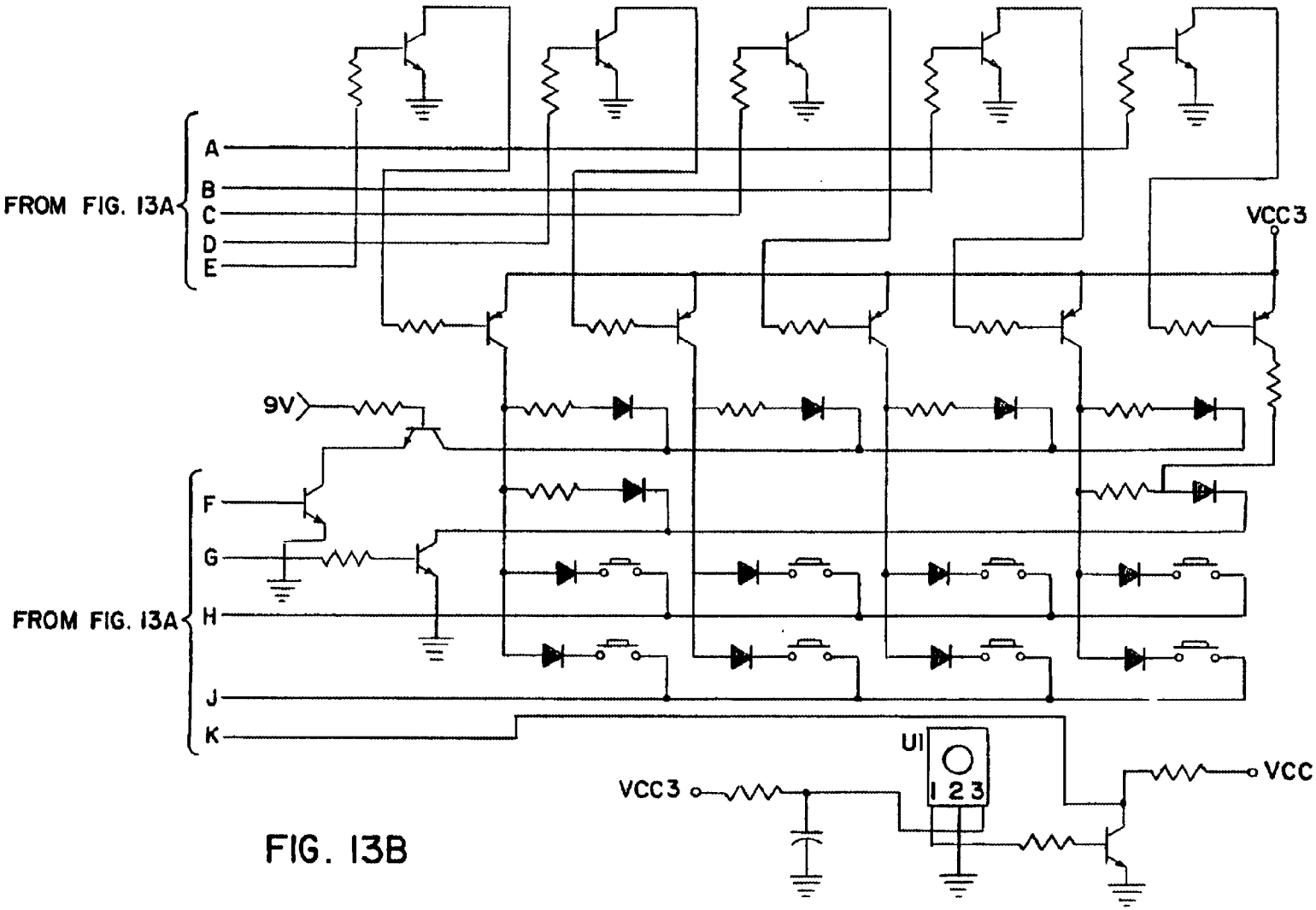

Then, the main board processor 98 scans for the inputs mentioned above including the owner's voice, other sound sources, light, overload, tilt, and reflections of infrared rays that have been bounced off objects in its environment. This is called the scanned inputs 126 phase. Other types of input include signals generated by the nose switch 116, pat switch 118 located on the top of the apparatus' head, and pet switches 120*a*, 120*b*, and 120*c* located along the back of the apparatus (see FIGS. 1A, 7C, and 13). The main board processor 98 prioritizes the data to determine what level of behavior is appropriate.

In determining the appropriate behavior to exhibit, the preferred embodiment of the present invention uses a stimuli accumulator that works as follows in the prioritize input data 128 step. Stimuli inputs such as voice, pet, touch, and motion input are quantified by accumulating the number of occurrences of these inputs over a five minute period during which they occur. These inputs are termed interaction parameters and are assigned "A" as a variable, the value of which is the number as determined above. Similarly, the environment parameters include sound inputs and light inputs and are assigned a variable "B",the value of which is calculated in a similar way as done for the interaction variables. Finally, the terrain parameters include floor, wall, tilt, and limb inputs and are assigned a variable "C",the value of which is calculated in the same way as mentioned for both the environment and interaction parameters. Once the main board processor 98 has determined these variables, it compares their values once a minute as shown in Table 1 to decode what state the apparatus should exhibit whether it be sad, happy, sick, sleepy, etc. It should be noted that since there are more inputs being measured for variables "A" and "C" that this comparison is weighted, thus the apparatus is more likely to exhibit states such as happy and hyper than sleepy or sick just like a real canine.

TABLE 1

MOOD DECODER TABLE

| STATES | DECODE |
|---|---|
| A = B + A = C | SAD |
| A = B + A > C | HAPPY |
| A = B + A < C | HYPER |
| A > B + A = C | HAPPY |
| A > B + A > C | HAPPY |
| A > B + A = C | HYPER |
| A < B + A = C | SAD |
| A < B + A > C | SLEEPY |
| A < B + A < C | SICK |

TABLE 2

TYPES OF ACTIVITIES

| OBEY Response to User Input | WAIT Lower Power Activities | EXPLORE Walk/Turn | TALK Make Noise |
|---|---|---|---|
| Tricks Interaction | Static Pose | Locomotion | Moods Status |
| Some Moods | Dynamic Pose | Some Moods | Annunciation of Moods |
| Annunciation (Yes/No) | (Display Mood) | Seeking/Searching | |

TABLE 3

PASSIVE STATE (NO USER INTERACTION)
ACTIVITIES PERCENTAGE
(user interaction by pressing the head switches for 5 sec forces obey mode for any mood, listening for obey will occur after the completion of the current activity)
IF THE USER SAYS "STAY" EXPLORE AND WALKING MODES ARE CANCELLED
"COME" RESTORES EXPLORE

| | OBEY | WAIT | EXPLORE | TALK |
|---|---|---|---|---|
| HYPER | 10% | 50% | 30% | 10% |
| HAPPY | 50% | 30% | 10% | 10% |
| SAD | 10% | 70% | 5% | 15% |
| SLEEPY | 10% | 70% | 5% | 15% |
| SICK | 5% | 80% | 1% | 14% |

Table 2 shows how these states of the apparatus correspond to the output behavior of the apparatus whether it be to obey, wait, explore, or talk. The apparatus executes a program depending on what state it is in. For example, the apparatus will wag its tail whenever it is hyper or happy. All non-ambulatory movements of the apparatus are controlled in this way. Table 3 shows how the apparatus apportions its behavior depending on the state of the apparatus when there is no user interaction. This is done based on a percentage of time displaying that type of behavior. For instance, if the apparatus is determined to be sick under Table 1 and there is no user interaction, the apparatus will display a waiting type of behavior eighty percent of the time. Through this type of programming, the apparatus can effectively implement the high level flow chart as shown in FIG. 9.

Figure 10:
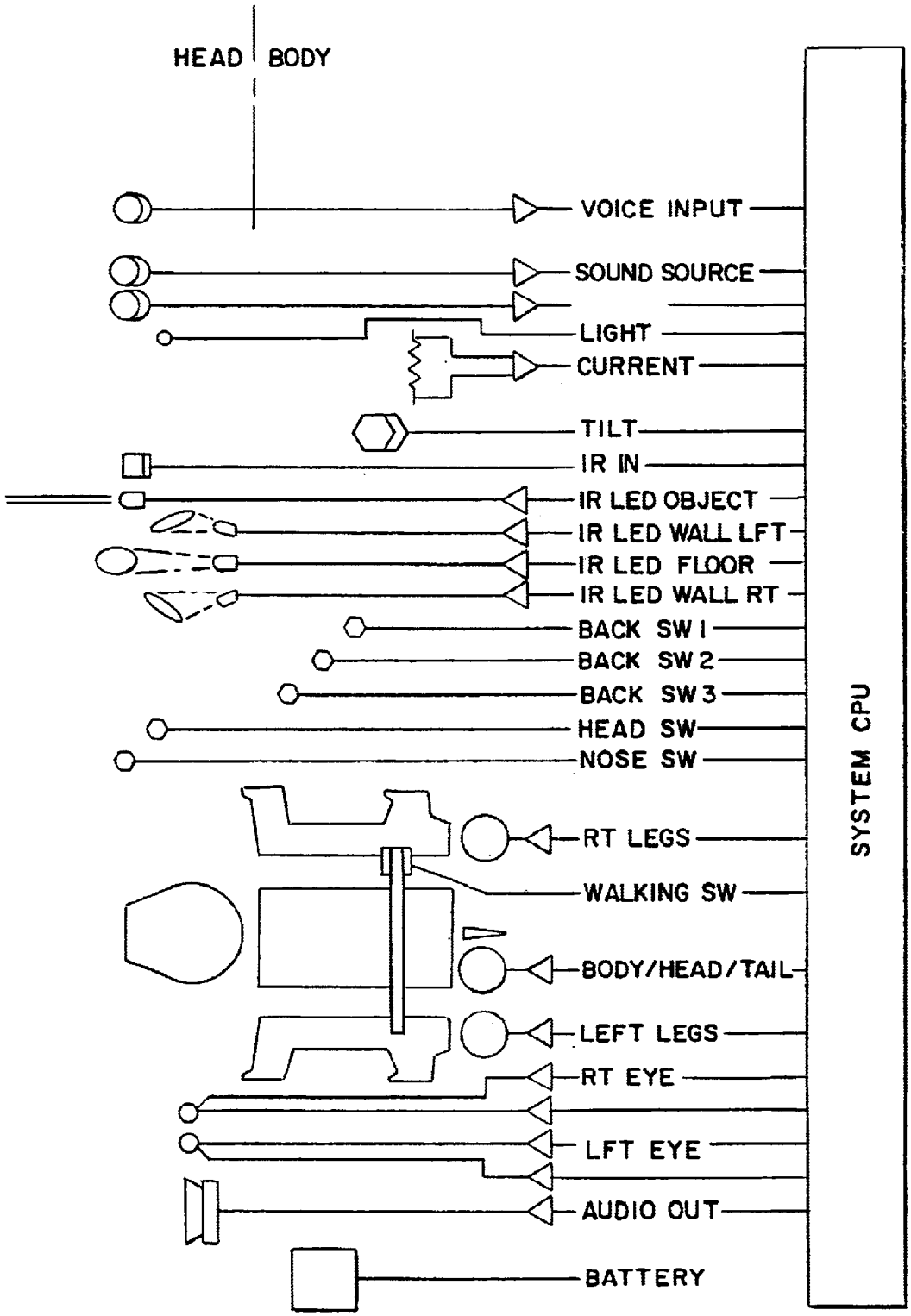
FIG. 10 is a system layout showing how the interactive components of the apparatus are connected to the system CPU.

If there is no input, then the apparatus will simulate a sleep mode 130 where there is no output. If the input level is low, then the apparatus exhibits a normal mode 132 of behavior where it will seek, sit, wag its tail, speak and look around like a dog normally does. It will also seek communication from the user or the environment using its input devices. If the input level is medium, then the apparatus will imitate a slow activity 134 level of behavior where it is more active in the level of output it generates. For instance, it may seek out an object in its environment. However, if the input is high then the apparatus begins to behave in a manner that is consistent with the way a dog does when it is threatened. The apparatus then stops its normal activity 136 and applies an iterative process where it tries to apply some corrective action 138 to remedy the problem. The problem could take the form of being confined in a tight area or being pinned down and unable to move. In such situations, the dog may even cry 140 if it is unable to solve the problem. As a result of this interaction between inputs, software, and outputs of the apparatus, it can behave more like a canine than prior art devices. See FIGS. 10 and 11 for more information about this interaction and FIGS. 12 and 13 for the wiring schematics of the entire apparatus.

As can be seen, the described embodiments fulfill the need for a self-phase synchronized walking and turning quadruped apparatus that can respond to stimuli in its environment in a canine way. It is also readily apparent to those skilled in the art that the features of the present invention are capable of being applied to apparati with less and more than four legs as well. While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. An apparatus that is capable of achieving self-synchronized walking and turning comprising:

a first motor attached to said apparatus having a drive shaft extending therefrom;

a first limb that is in communication with said first motor;

a second motor, independent from said first motor, that is attached to said apparatus having a drive shaft extending therefrom;

a second limb that is in communication with said second motor, said second limb being independent of said first motor, whereby said second limb is capable of moving at a different rate than said first limb; and at least one damper mechanism that is interposed between said first limb, or any movable member mechanically linked thereto, and said second limb, or any movable member mechanically linked thereto, whereby a any change in phase differential between said first limb and said second limb is resisted but can be accomplished.

2. The apparatus of claim 1 wherein said communication between said first motor and said first limb comprises:

a first crank shaft; and a first gear train that reduces the angular speed of rotation of said first crank shaft as compared to that of said drive shaft of said first motor, said first gear train including:

a first gear fixedly attached to said drive shaft of said first motor; and a second gear that is fixedly attached to said first crank shaft.

3. The apparatus of claim 1 wherein said communication between said second motor and said second limb comprises:

a second crank shaft; and a second gear train that reduces the angular speed of rotation of said second crank shaft as compared to that of said drive shaft of said second motor, said second gear train including:

a first gear fixedly attached to said drive shaft of said second motor; and a second gear that is fixedly attached to said second crank shaft.

4. The apparatus of claim 3 wherein said first limb comprises a first front limb and a first bell crank that has a portion the includes a first rear limb, said first bell crank being rotatably and eccentrically attached to said first crank shaft, whereby said first crank shaft drives said first bell crank.

5. The apparatus of claim 4 wherein said first front limb is rotatably attached to said first bell crank and to said apparatus with the axis of rotation of the attachment to said first bell crank being eccentric to the axis of rotation of the attachment to said apparatus, whereby said first bell crank moves said first front limb while said first front limb is mechanically coupled to said apparatus.

6. The apparatus of claim 5 wherein said second limb comprises a second front limb and a second bell crank that has a portion the includes a second rear limb, said second bell crank being rotatably and eccentrically attached to said second crank shaft, whereby said second crank shaft drives said second bell crank.

7. The apparatus of claim 6 wherein said second front limb is rotatably attached to said second bell crank and to said apparatus with the axis of rotation of the attachment to said second bell crank being eccentric to the axis of rotation of the attachment to said apparatus, whereby said second bell crank moves said second front limb while said second front limb is mechanically coupled to said apparatus.

8. The apparatus of claim 7 which further comprises a phase lock bar that is rotatably attached to said apparatus at a pivot point.

9. The apparatus of claim 8 wherein said damper mechanism is a first damper mechanism which comprises a first compression spring that is in contact with said phase lock bar and said first bell crank.

10. The apparatus of claim 9 further comprising a second damper mechanism which includes a second compression spring that is in contact with said phase lock bar and said second bell crank.

11. The apparatus of claim 10 wherein a clutch is interposed between any motor and any bell crank mechanically linked thereto, whereby the motor will be disengaged from the bell crank if any corresponding limb becomes entangled and unable to move, thereby preventing damage to the motor.

12. The apparatus of claim 1 wherein a first regulator controls said first motor causing said first motor to change the speed of rotation of said drive shaft, thereby changing the rate at which said first limb mimics a walking motion.

13. The apparatus of claim 12 wherein a second regulator controls said second motor causing said second motor to change the speed of rotation of said drive shaft, thereby changing the rate at which said second limb mimics a walking motion.

14. The apparatus of claim 13 which further comprises a third motor, said motor being capable of causing the apparatus to lie down or perform other non-ambulatory movements.

15. The apparatus of claim 14 wherein said apparatus includes means to control said first and said second regulators, causing said first motor and said first limb to have a phase differential of less than or greater than 180 degrees with respect to said second motor and said second limb, thereby causing said apparatus to turn.

16. The apparatus of claim 15 wherein said means for controlling said regulators includes means for voice input and output computer control, allowing the user to tell the apparatus to walk, turn, stop, and bark.

17. The apparatus of claim 15 wherein said means for controlling said regulators includes means for using an infrared sensor and emitter to detect objects in its environment and move toward them or to detect obstructions in its environment and avoid them.

18. The apparatus of claim 1 wherein said apparatus responds to stimuli in its environment by learning and changing the level of its activity between different levels that include sleeping and normal activity.

* * * * *